US006045062A

United States Patent [19]

Bosio

[11] Patent Number: 6,045,062

[45] Date of Patent: Apr. 4, 2000

[54] SHOWER HEAD

[75] Inventor: Orlando Bosio, Casaloldo, Italy

[73] Assignee: Amfag S.p.A., Castelgoffredo, Italy

[21] Appl. No.: 09/112,216

[22] Filed: Jul. 9, 1998

[30] Foreign Application Priority Data

Jul. 15, 1997 [IT] Italy ..... MN970026 U

[51] Int. Cl.[7] ..... A62C 31/00

[52] U.S. Cl. ..... 239/443; 239/530; 239/583; 137/801

[58] Field of Search ..... 239/436, 443, 239/444, 446–449, 525, 530, 583; 137/801; 4/615

[56] References Cited

U.S. PATENT DOCUMENTS 4,629,124 12/1986 Gruber ..... 239/436

5,145,114 9/1992 Monch ..... 239/443

5,575,424 11/1996 Fleischmann ..... 239/436

5,707,011 1/1998 Bosio ..... 239/447

5,806,771 9/1998 Loschelder et al. ..... 239/446

*Primary Examiner*—Andres Kashnikow

*Assistant Examiner*—Lisa Ann Douglas

*Attorney, Agent, or Firm*—Guido Modiano; Albert Josif

[57] ABSTRACT

A shower head comprising an insert which is suitable to make the cap that covers the monolithic assembly formed by a button and a return lever for the actuation of the device for switching from a central jet to a peripheral jet and viceversa appear to be divided into two portions: one which lies above the button and one which lies above the return lever.

13 Claims, 4 Drawing Sheets

SHOWER HEAD

BACKGROUND OF THE INVENTION

The present invention relates to a shower head.

Conventional shower heads, particularly used in kitchen sinks, are provided with an outer shell which is shaped so as to form a tubular portion which acts as a handle and contains an elongated insert having, at one end, a threaded portion for connection to a water feed duct, and connected at its other end to a cylindrical insert which is contained in a head-shaped portion of the shell and is locked therein by a plug provided with openings for the outflow of the water which are suitable to selectively form a central jet and a peripheral jet.

Said cylindrical insert contains the device that provides switching from a central jet to a peripheral jet and viceversa and comprises, as means for its actuation by a user, a button and a return lever which are monolithically associated and are covered by a single cap made of elastic material which is associated with the outer shell. Pressing the button when the water flows out as a central jet produces switching to a peripheral jet; the return lever is pressed in order to return to the central-jet condition.

Covering the monolithic assembly formed by the button and by the return lever with a single cap is certainly economical in terms of construction and assembly and produces an aesthetically pleasing situation. Accordingly, this constitutes an improvement with respect to equally known solutions in which the presence of two buttons which protrude separately from the shell leads to constructive complications, is unaesthetic and triggers dirt deposits. However, it also entails a drawback, namely the uncertainty that it produces in the user in terms of determining the exact point to be pressed in order to actuate the button or, as an alternative, the return lever, since no precise indications in this regard are given.

It should also be noted that conventional shower heads have a handle with a smooth surface, which as such provides a possibly unsteady grip, or has a surface provided with large raised portions, which become regions where dirt deposits easily.

SUMMARY OF THE INVENTION

The aim of the present invention is to provide a shower head in which the characteristics of low cost, aesthetic pleasantness and cleanliness observed in known single-cap embodiments are preserved, eliminating the uncertainties in the actuation of the device for switching from central jet to peripheral jet and viceversa that are found in the above prior art.

Within the scope of this aim an object of the present invention is to provide a shower head whose handle is suitable to provide a safe grip and is free from regions where dirt can deposit easily.

This aim, these objects and others which will become apparent hereinafter are achieved by a shower body according to the invention, which comprises an outer shell shaped so as to form a tubular portion which acts as a handle and a head which contains a cylindrical insert which receives the water from an elongated insert contained in the handle, is blocked by means of a plug provided with openings for the outflow of the water which are suitable to selectively form a central jet and a peripheral jet, and comprises a device which provides switching from a central jet to a peripheral jet and viceversa as a consequence of the actuation of a button and of a return lever, characterized in that said button and said lever are monolithically associated and covered by a cap made of elastic material which is associated with said outer shell; and in that an insert is provided which is suitable to make said cap appear to be divided into two portions: one which lies above said button and one which lies above said return lever.

The shower head according to the invention is also characterized in that it comprises at least one insert made of soft material which is accommodated in a corresponding opening formed at the handle.

BRIEF DESCRIPTION OF THE DRAWINGS

Further characteristics and advantages of the present invention will become apparent from the following detailed description of a shower head, illustrated only by way of non-limitative example in the accompanying drawings, wherein.

DESCRIPTION OF THE PREFERRED EMBODIMENTS

Figure 1:
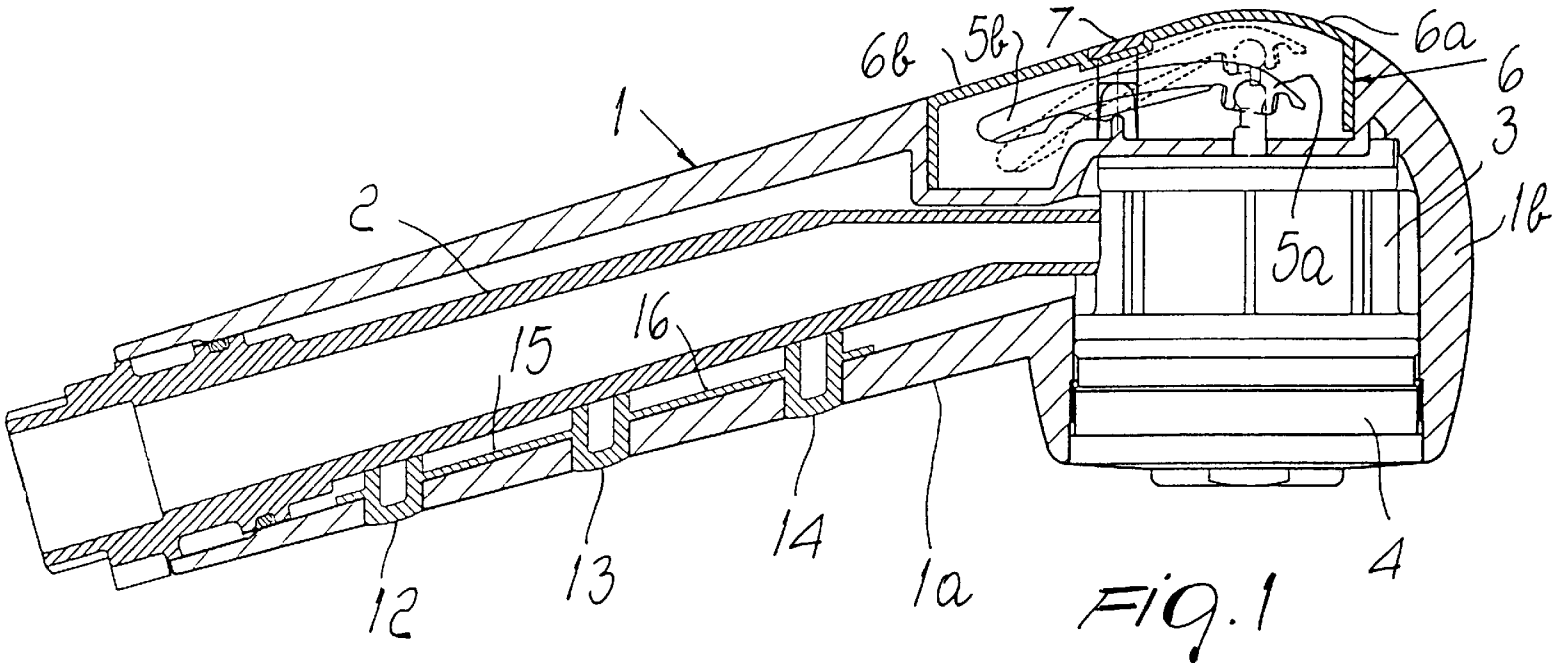
FIG. 1 is a sectional side view of the shower head according to the present invention, taken along a longitudinal plane.
Figure 10:
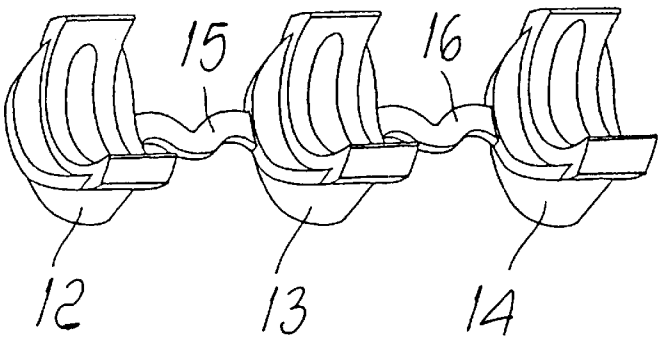
FIG. 10 is a perspective view of the cluster of inserts accommodated in the openings provided in the handle.
Figure 2:
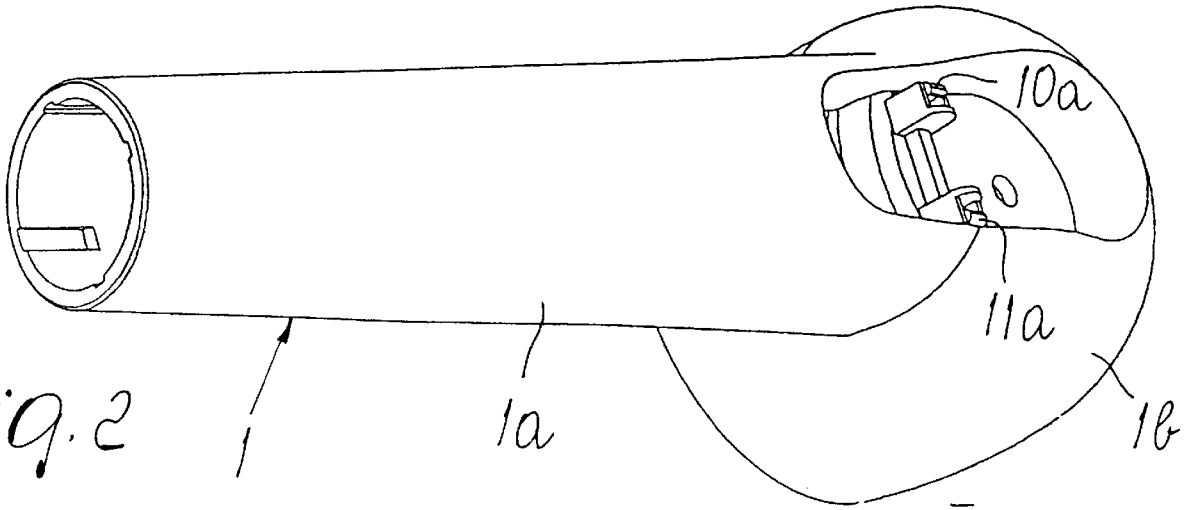
FIG. 2 is a perspective view of the outer shell of the shower head of FIG. 1.
Figure 3:
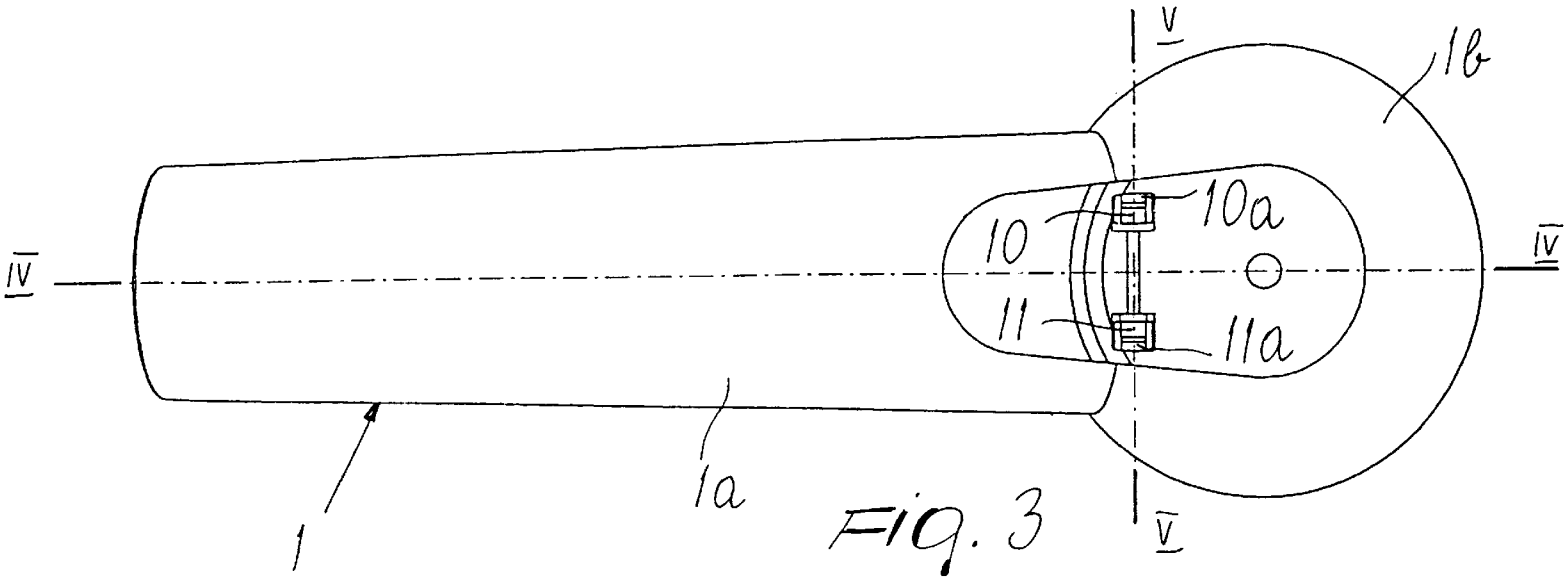
FIG. 3 is a top view of the outer shell.
Figure 4:
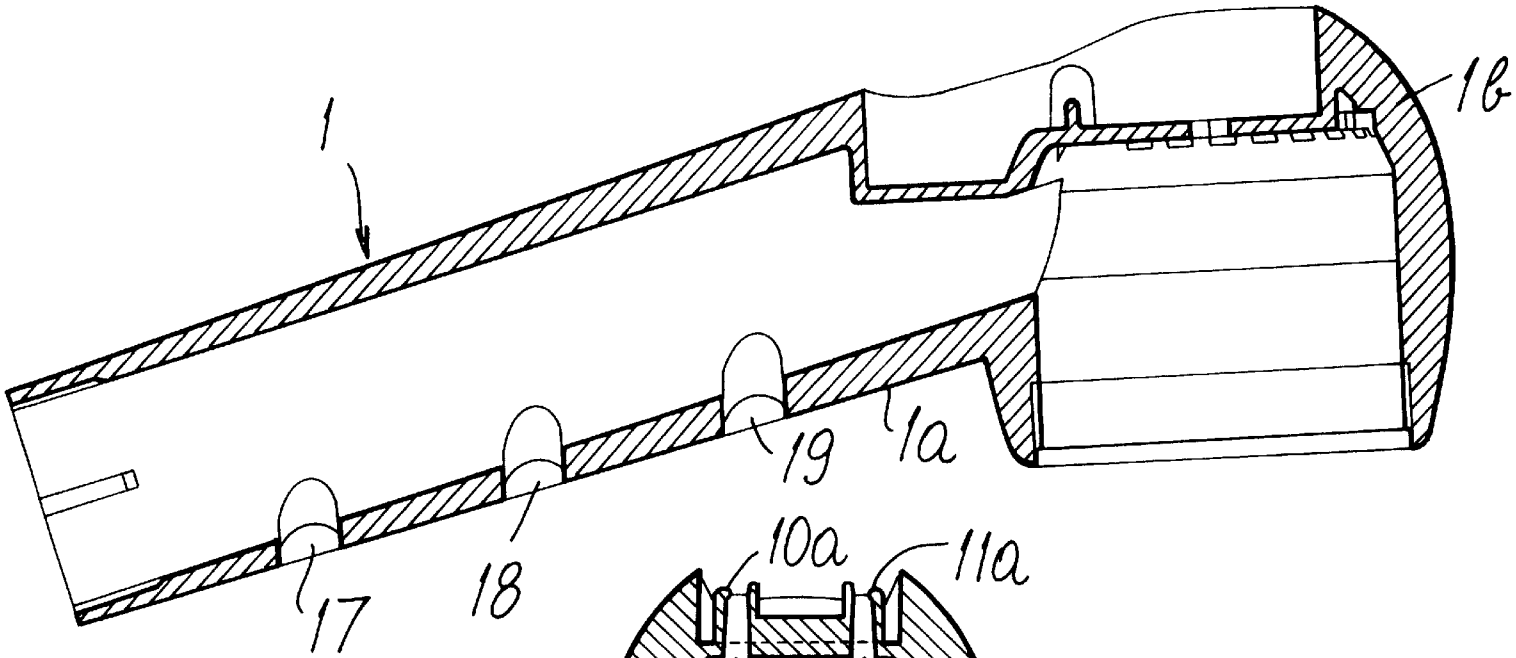
FIG. 4 is a sectional view, taken along the plane IV—IV of FIG. 3.
Figure 5:
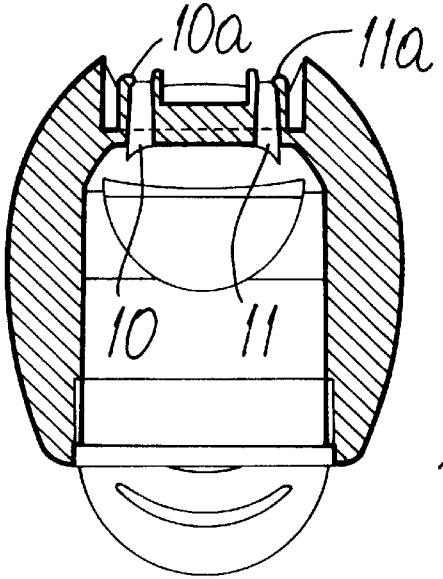
FIG. 5 is a sectional view, taken along the plane V—V of FIG. 3.
Figure 8:
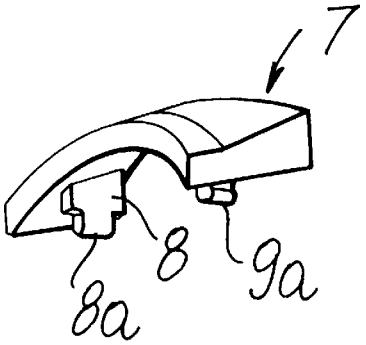
FIG. 8 is a perspective view of the insert of the shower head.
Figure 9:
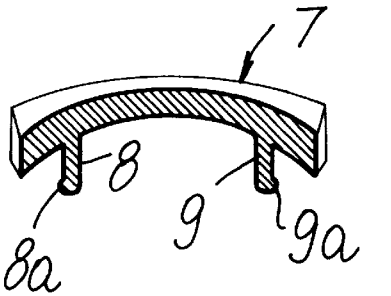
FIG. 9 is a transverse sectional view of the insert.
Figure 6:
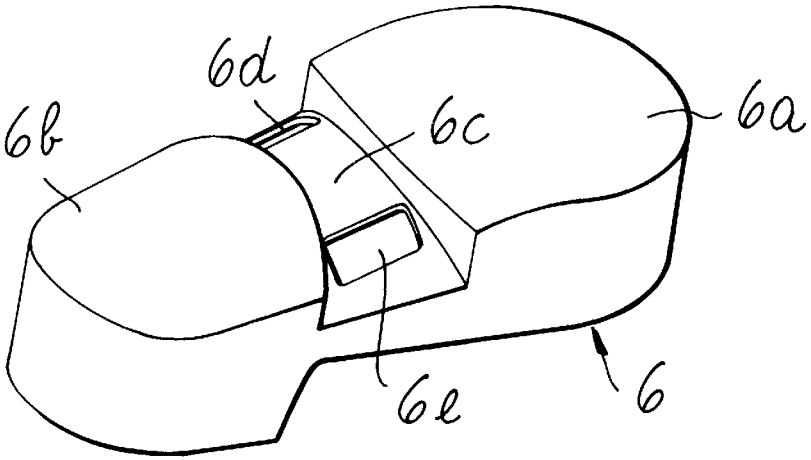
FIG. 6 is a perspective view of the cap of the shower head.
Figure 7:
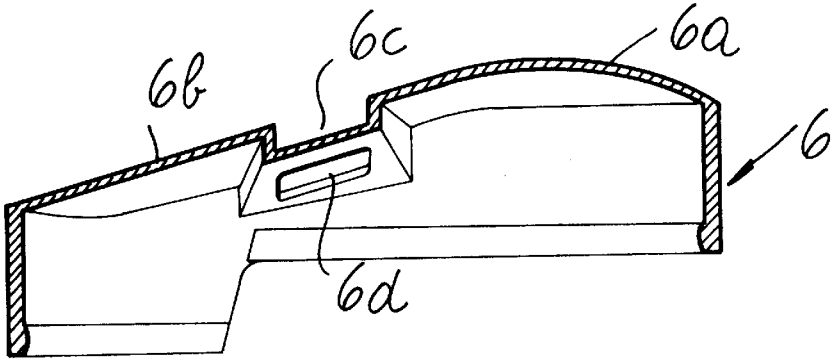
FIG. 7 is a longitudinal sectional view of the cap.

With reference to the above figures, the reference numeral 1 generally designates the outer shell of the shower head, which comprises a tubular portion 1*a*, which acts as a handle, and a head 1*b*. The tubular portion 1*a* and the head 1*b* are mutually connected.

An elongated insert 2 is provided in the tubular portion 1*a* and has, at the end that protrudes from the shell 1, a threaded portion for connection to a water supply pipe and is associated, at its other end, with a cylindrical insert 3 which is accommodated in the head 1*b* and is locked therein by a plug 4, which is provided with water outflow openings suitable to selectively form a central jet and a peripheral jet.

The cylindrical insert 3 contains a device that provides switching from central jet to peripheral jet and viceversa. The device comprises, as means for actuation by a user, a button 5*a* and a return lever 5*b*, which are monolithically associated in a single assembly. By pressing the button 5*a* in the position shown in dashed lines, which makes the water flow out as a central jet, switching to a peripheral jet is performed; to return to the central-jet condition the return lever 5*b* must be pressed.

All this occurs in a known manner.

An important characteristic of the present invention is the fact that the monolithic assembly formed by the button 5*a* and by the return lever 5*b* is covered by a cap made of elastic material, generally designated by the reference numeral 6, which is inserted in a suitable seat formed in the shell 1 and is surmounted by a rigid insert 7, which is connected to the shell 1, so that the user sees it divided into two portions: a portion 6*a*, which lies above the button 5*a*, and a portion 6*b*, which lies above the return lever 5*b*.

More specifically, the rigid insert 7 lies within a seat 6*c* which is provided in the cap 6 between the portions 6*a*, 6*b* and has such a depth as to provide continuity, as shown in FIG. 1, between the surfaces of the insert 7 and of the cap 6.

In order to provide connection to the outer shell 1, the insert 7 has feet 8 and 9 with end protrusions 8*a*, 9*a* which, by passing through corresponding openings 6*d*, 6*e* formed in the cap 6, enter holes 10 and 11 formed in the shell 1, with a snap engagement of the protrusions 8*a*, 9*a* on raised portions 10*a*, 11*a* provided at the ends of the holes 10 and 11.

This configuration of the means for connecting the rigid insert 7 to the outer shell 1 is particularly advantageous at the construction level, especially because of the possibility to provide the through holes 10 and 11 in the shell 1 allowed by the particular characteristic of the cylindrical insert 3 of being waterproof; this In any case, it is evident that various different embodiments of said connection means are possible.

The insert 7 may also be connected-directly to the cap 6.

The definition, performed by the insert 7, of the two cap portions 6*a*, 6*b* arranged respectively above the button 5*a* and above the return lever 5*b* allows the user to have a precise indication as to the method of actuation required to achieve the intended switching from central jet to peripheral jet and viceversa. A situation which can be obtained easily from the constructive point of view and has a good aesthetic value is also achieved.

It should also be noted that the described insert 7 is advantageously made of a rigid material and that it also has dimensions which allow to provide thereon differentiated identification markings, thus sparing the manufacturer the need to apply the markings on the outer shell, with consequent inventory problems.

Another important characteristic of the invention is the presence of inserts 12, 13 and 14 made of soft material, which are joined in a cluster by bands 15 and 16 and are inserted in openings 17, 18 and 19 which lie transversely to the handle at the portion of wall that is directed towards the water outlet region.

The inserts 12–14 protrude slightly from the corresponding openings 17–19, are arranged so as to be substantially continuous with the surrounding wall, so that the user perceives their presence by touch mainly by virtue of the differentiation of the material, and are extended towards the inside of the handle so as to make contact with the elongated insert 2 provided therein and be locked thereby.

It is understood that the described inserts 12–14 made of soft material may assume different shapes.

The disclosures in Italian Patent Application No. MN97U000026 from which this application claims priority is incorporated herein by reference.

In the practical embodiment of the invention, all the details may be replaced with other technically equivalent elements; the materials employed, as well as the shapes and the dimensions, may also be any according to requirements.

What is claimed is:

1. A shower head comprising an outer shell which is shaped so as to form a tubular portion which acts as a handle and a head which contains a cylindrical insert which receives the water from an elongated insert contained in the handle, the cylindrical insert is blocked by means of a plug provided with openings for the outflow of the water which are suitable to selectively form a central jet and a peripheral jet, and comprises a device which provides switching from a central jet to a peripheral jet and viceversa as a consequence of the actuation of a button and of a return lever, wherein said button and said lever are monolithically associated and covered by a cap made of elastic material which is associated with said outer shell; and wherein a third insert is provided which is suitable to make said cap appear to be divided into two portions: one which lies above said button and one which lies above said return lever.

2. A shower head according to claim 1, wherein said third insert is provided with means for connection to the outer shell, so as to surmount said cap.

3. A shower head according to claim 1, wherein the third insert is connected to the cap.

4. A shower head according to claim 1, wherein a seat is provided within the cap which is suitable to accommodate the third insert.

5. A shower head according to claim 4, wherein the seat in the cap has a depth which is substantially equal to the thickness of the third insert, so as to produce a substantial continuity of the surfaces of said third insert and of said cap.

6. A shower head according to claim 1, wherein the third insert has at least one foot which passes through a corresponding opening formed in the cap, said foot being provided with means for engaging the outer shell.

7. A shower head according to claim 6, wherein said cylindrical insert is waterproof, wherein the at least one foot that protrudes from the third insert is suitable to enter a hole provided in the outer shell to remain locked by snap action.

8. A shower head according to claim 1, wherein the third insert comprises two feet which are arranged symmetrically.

9. A shower head according to claim 1, wherein identification markings are placed on the third insert.

10. A shower head according to claim 1, further comprising at least one insert made of soft material which is accommodated in a corresponding opening provided at the handle.

11. A shower head according to claim 10, wherein said at least one insert made of soft material is arranged substantially so as to be continuous with the wall of said handle.

12. A shower head according to claim 10, further comprising a plurality of inserts made of soft material which are accommodated in corresponding openings that lie transversely to the handle at the wall portion that is directed towards the water outlet.

13. A shower head according to claim 12, wherein the plurality of inserts made of soft material are joined in a cluster and are extended towards the inside of the handle, so as to make a locking contact with the elongated insert provided in said handle.

* * * * *